US007661488B2

(12) United States Patent
Andoskin et al.

(10) Patent No.: US 7,661,488 B2
(45) Date of Patent: Feb. 16, 2010

(54) REGULATOR OF ANGLE AND REACTIVE MOMENT OF A GEROTOR TYPE MOTOR HAVING A SPINDLE AND DRILLING BIT IN A BENT DRILLING STRING

(75) Inventors: Vladimir Nikolaevich Andoskin, Perm (RU); Konstantin Anatolievich Kobelev, Perm (RU); Vladimir Ivanovich Timofeev, Perm (RU)

(73) Assignee: Obschestvo S Ogranichennoi Otvetstvennostyu'Tirma "Radius-Servis", Perm (RU)

( * ) Notice: Subject to any disclaimer, the term of this patent is extended or adjusted under 35 U.S.C. 154(b) by 240 days.

(21) Appl. No.: 10/568,323

(22) PCT Filed: Feb. 3, 2004

(86) PCT No.: PCT/RU2004/000030

§ 371 (c)(1),
(2), (4) Date: Jul. 11, 2007

(87) PCT Pub. No.: WO2005/017305

PCT Pub. Date: Apr. 24, 2005

(65) Prior Publication Data

US 2008/0099247 A1 May 1, 2008

(30) Foreign Application Priority Data

Aug. 18, 2003 (RU) ..... 2003125526

(51) Int. Cl.
*E21B 7/08* (2006.01)

(52) U.S. Cl. ..... 175/74; 175/61; 175/320; 285/184

(58) Field of Classification Search ..... 175/73, 175/74, 61, 320; 285/184
See application file for complete search history.

(56) References Cited

U.S. PATENT DOCUMENTS

| | | | |
|---|---|---|---|
| 4,745,982 | A | 5/1988 | Wenzel |
| 5,343,966 | A | 9/1994 | Wenzel et al. |

FOREIGN PATENT DOCUMENTS

| | | | |
|---|---|---|---|
| RU | 2 103 474 | C1 | 1/1998 |
| RU | 2 115 792 | C1 | 7/1998 |
| RU | 2149971 | C1 | 5/2000 |
| RU | 2 186 923 | C1 | 9/2000 |
| SU | 905411 | | 2/1982 |

OTHER PUBLICATIONS

N. T. Ovchinnikov, Drill String Bottom Assembly at Loading, Gas Industry, Production and Technical Magazine, Feb. 1998, No. 2, pp. 42-44.

*Primary Examiner*—Giovanna C Wright
(74) *Attorney, Agent, or Firm*—Fitch, Even, Tabin & Flannery

(57) ABSTRACT

A device for drilling controlled directional wells comprises a central hollow element and three hollow tubular elements connected thereto out-of-line with respect to each other. The first hollow tubular element connected by a thread to the spindle and the central hollow element, are each provided with a contact segmental section, thereby forming a pair of contact segmental sections. The sections are disposed on the opposite sides with respect to the meridian plane of the spindle in the bending plane of the drill string and at a distance L between the nearest edges of the contact segmental sections along the central axis of the first element. L≧D, where D is the spindle outer diameter. The contact segmental section of the first element is deviated from the meridian plane of the spindle in the bending plane of the drilling string in an opposite direction with respect to the reaction torque of a drilling bit.

2 Claims, 7 Drawing Sheets

5B – 5B

10C – 10C

REGULATOR OF ANGLE AND REACTIVE MOMENT OF A GEROTOR TYPE MOTOR HAVING A SPINDLE AND DRILLING BIT IN A BENT DRILLING STRING

FIELD OF THE INVENTION

The invention relates to devices for drilling the oil and gas inclined wells, in particular it relates to regulators of angle and reactive moment of a gerotor type motor having a spindle and drilling bit in a bent drilling string.

BACKGROUND OF THE INVENTION

Known is a gerotor type motor, comprising a hollow housing, a multiple-lead gear-rotored mechanism that is positioned in said housing and includes a coaxially disposed stator, and a rotor positioned within the stator, and also a spindle that is coupled, via a drive shaft, to the rotor and positioned within the spindle housing, the motor and spindle housings being interconnected using a bent substitute having threads on its edges [RU Patent 2149971, E 21B4/02, 7/08, 1999].

In this prior-art design the motor and spindle housings are connected to the bent substitute by means of threaded enclosures; the rotor and spindle being interconnected by the drive shaft using threaded adapters; the inner cavity of one of the threaded enclosures is provided with an annular bead, which bead accommodates a ring; the ring inner diameter is provided with a gap with respect to the drive shaft, and value of said gap does not exceed that of the substitute outer diameter; the bent substitute, on its edges, has threads having the crossing axes; and the longest distance between said threads axes is equal to the rotor s eccentricity with respect to the stator.

A disadvantage of this known design is as follows: setting of another angle value, and compensating of the lateral force imparted by the drilling bit using the reactive moment occurring on the substitute, the bent drilling string s motor and spindle, need disengagement of the motor from the spindle so that to enable replacement of the substitute.

Another disadvantage of this known design consists in an incomplete utilization of the possibilities for compensating the lateral force imparted by the drilling bit (at a certain value of angle on the substitute), and in a narrow range of said force, as the longest distance between the crossing threads axes does not exceed the value of the rotor eccentricity with respect to the stator.

This circumstance does not allow to compensate the positive and negatives peaks of fluctuations of the axial load on the drilling bit, and to maintain the optimum axial load on the drilling bit by preserving the axial load current values without loss of stability of a slanted-directional bent drilling string.

Known is the angle regulator, consisting of a central hollow element and three hollow mutually misaligned tubular elements connected with said central element, each of which three tubular elements has an inner through opening, wherein the inner hollow tubular element being disposed in the centre between the first and second elements, and the first and second tubular elements being connected to the inner hollow tubular element by the threads provided on their edges that face one another, the first and second tubular elements being connected by a thread to the gerotor type motor housing [U.S. Pat. No. 5,343,966, E 21B7/08, 1994].

In this known design, the first or second tubular elements are intended to connect the gerotor type motor housing to the spindle or a drill pipe, the central and inner hollow tubular elements being interconnected by a splined joint, and providing for re-setting of a new angle value when a drilling string is lifted, without disengagement from the downhole motor.

A disadvantage of this prior-art design is the lack of compensation of the lateral force imparted by the drilling bit by the use of the reactive moment occurring on the angle regulator, motor and spindle of a bent drilling string, during penetration through a well bottom heterogeneity.

In these circumstances, optimisation of penetration wells is difficult to achieve due to the difficulty to correct for the component of the lateral force exerted on the drilling bit, which force brings about the reactive bending moment that changes its direction (sign) when a slanted-directional bent drilling string loses its stability (see Gazovaya Promyshlennost Journal [Gas Industry], February 1998, pp. 42-44).

This difficulty affects accuracy of sinking the inclined wells due to the unforecastable component of the lateral force exerted on the drilling bit, so that drilling parameters cannot be optimized, and in particular the optimum axial load acting on the drilling bit cannot be maintained by preserving the axial load current values without loss of stability of the bent drilling string.

The art most pertinent to the claimed design is a regulator of an angle and reactive moment of a gerotor type motor, comprising:

a central hollow element and three hollow tubular elements connected to said central hollow element;

each of which the hollow tubular elements having a through opening;

a first tubular hollow element having one axis;

a second tubular hollow element having another axis;

an inner hollow element being disposed in the centre between the first and second elements, and having a third axis;

wherein the first and second tubular elements being connected to the inner hollow element by the threads provided on the edges facing one another;

the first hollow tubular element being connected to a spindle by a thread;

the second hollow tubular element being connected to the motor housing by a thread;

the central hollow element being connected to the inner hollow element by splines;

the inner hollow element having threads on its edges, the threads have axes that cross one another and the central axis;

the longest distance between said threads axes is the double value of the rotor eccentricity with respect to the gerotor type motor stator;

the longest distance between its central axis and axes of any of the threads on its edges being equal to the rotor eccentricity with respect to the gerotor type motor stator (U.S. Pat. No. 2,186,923, E 21B4/02, 7/08, 2000].

A disadvantage of this known design is an incomplete utilisation of a possibility to increase the deviation angle and improve penetrating capability of the gerotor type motor having a spindle and drilling bit in a bent drilling string by compensation of the resultant radially-unbalanced force generated during rotation of a drilling bit in a borehole.

In this prior-art design, the regulator has not its own contact segmental sections, which sections would improve stability of a bent drilling string, for example—any sections that would be provided at different sides with respect to the string bend plane and would ensure the continuous contact with the borehole wall in time of drilling, and also would further increase accuracy of penetration into a well bottom heterogeneity by way of providing an optimum axial load on the drilling bit, without loss of stability of the bent drilling string.

DISCLOSURE OF THE INVENTION

The technical problem to be solved by the invention consists in improving stability of a gerotor type motor, regulator and spindle in the drilling string bend plane, increasing a deviation angle and improving penetrating capability of a gerotor type motor having a spindle and drilling bit in a bent drilling string by compensating the resultant radially-unbalanced force generated during rotation of a drilling bit in a borehole and by holding the own contact segmental sections on the regulator, at different sides with respect to the drilling string bend plane, in contact with the borehole well while drilling, as well as by an increased accuracy of penetration into a well bottom heterogeneity by provision of an optimum axial load on the drilling bit, without loss of stability of the bent drilling string.

The essence of the claimed technical solution is as follows:

in a regulator of angle and reactive moment of a gerotor type motor having a spindle and drilling bit in a bent drill string, consisting of a central hollow element and three hollow mutually misaligned tubular elements connected to said central hollow element, each of which three elements having an inner through opening;

the inner hollow element being disposed in the centre between the first and second elements;

the first and second tubular elements being connected to the inner hollow element by the threads provided on their edges that face one another;

the first hollow tubular element being connected by a thread to the spindle;

the second hollow tubular element being connected by a thread to the gear-rotored type motor housing;

the central hollow element being connected to the inner hollow element by splines;

the inner hollow element having threads on its edges, the threads having axes that cross one another and the central axis of the inner hollow element;

the longest distance between said threads axes is the double value of rotor s eccentricity with respect to the gerotor type motor stator;

the longest distance between its central axis of the inner hollow element and any of the threads on its edges being equal to the rotor s eccentricity with respect to the gerotor type motor stator;

the central hollow element and the first hollow tubular element, at the side where said first element is connected to the spindle, both are provided with their own contact segmental section, said contact segmental sections constitute the pair of the contact segmental sections disposed at different sides with respect to the meridian plane of the spindle in the drilling string bend plane, wherein the proximate edges of the contact segmental sections are disposed along the central axis at distance L , which has the following relationship with spindle outer diameter D: $L \geqq D$, and the angular deviation of the first hollow tubular element s contact segmental section (in cross-section) from the spindle meridian plane in the drilling string bend plane is provided in the opposite direction relative to the reactive moment imparted by the drilling bit.

Further, the contact segmental sections generatrices on the central hollow element and on the first hollow tubular element are disposed over the external face of a respective tubular element, and each one of the contact segmental sections comprising rows of teeth or pins secured on the tubular element, wherein hardness of the teeth or pins is greater than that of the sections.

Implementation of the central hollow element and the first hollow tubular element, at the side where the first element is connected to the spindle, in such manner that each one of said elements has its own contact segmental section so that they between them constitute pairs of the contact segmental sections disposed at different sides with respect to the spindle meridian plane in the drilling string bend plane, and along the central axis of the first hollow element said sections being disposed at distance L between the proximate edges of the contact segmental sections, which distance has the following relationship with spindle outer diameter D: $L \geqq D$, wherein the angular deviation of the first hollow tubular element s contact segmental section from the spindle meridian plane in the drilling string bend plane being provided in the opposite direction relative to the reactive moment imparted by the drilling bit, allows to shift the drilling bit rotation centre against rotation thereof, and compensate the lateral force acting in the bent well string head, thereby preventing a change in the inclination angle caused by re-distribution of reactions of the lateral force affecting the drilling bit depending on the axial load, without loss of stability of the bent drilling string.

This arrangement allows to optimise and improve accuracy of well sinking owing to an increased precision of correcting for the component of the lateral force acting on the drilling bit, which component brings about the bending moment that alters its direction (sign) when the inclined bent drilling string loses stability.

Arrangement of the contact segmental sections generatrices on the central hollow element and on the first hollow tubular element over the external surface of a respective tubular element, and provision of each one of the contact segmental sections with rows of teeth or pins secured on the tubular element, hardness of which teeth or pins is greater than that of the sections, improves stability of the gerotor type motor, regulator and spindle in the drilling string bend plane, prolongs service life of the regulator when the same is abraded against the wellbore walls, and ensures compensation of the positive and negatives peaks of fluctuations of the axial load on the drilling bit, and the optimum axial load on the drilling bit by preserving the axial load current values without loss of stability of a slanted-directional bent drilling string.

On the whole, this technical solution allows to compensate the resultant radially-unbalanced force generated during rotation of the drilling bit in the borehole, and to hold its own contact segmental sections on the regulator at different sides with respect to the drilling string bend plane in contact with the borehole wall in time of drilling.

THE BEST MODE FOR EMBODYING THE INVENTION

Figure 1:
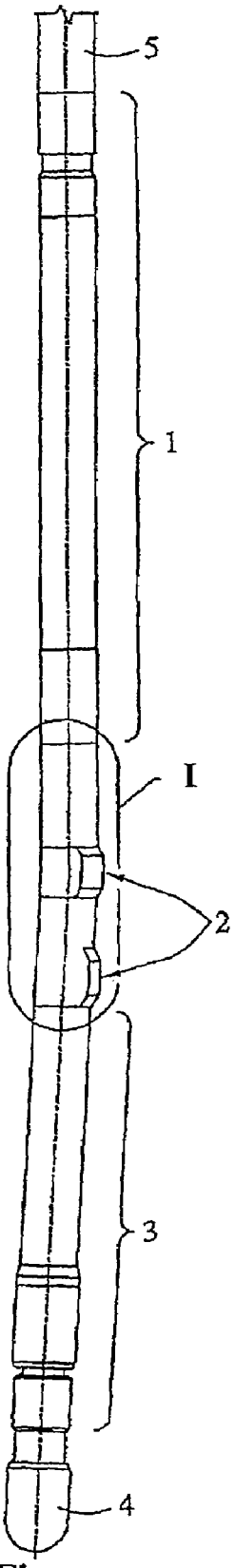
FIG. 1 shows a gerotor type motor having a regulator of angle and reactive moment, a spindle and drilling bit in a bent drilling string.
Figure 2:
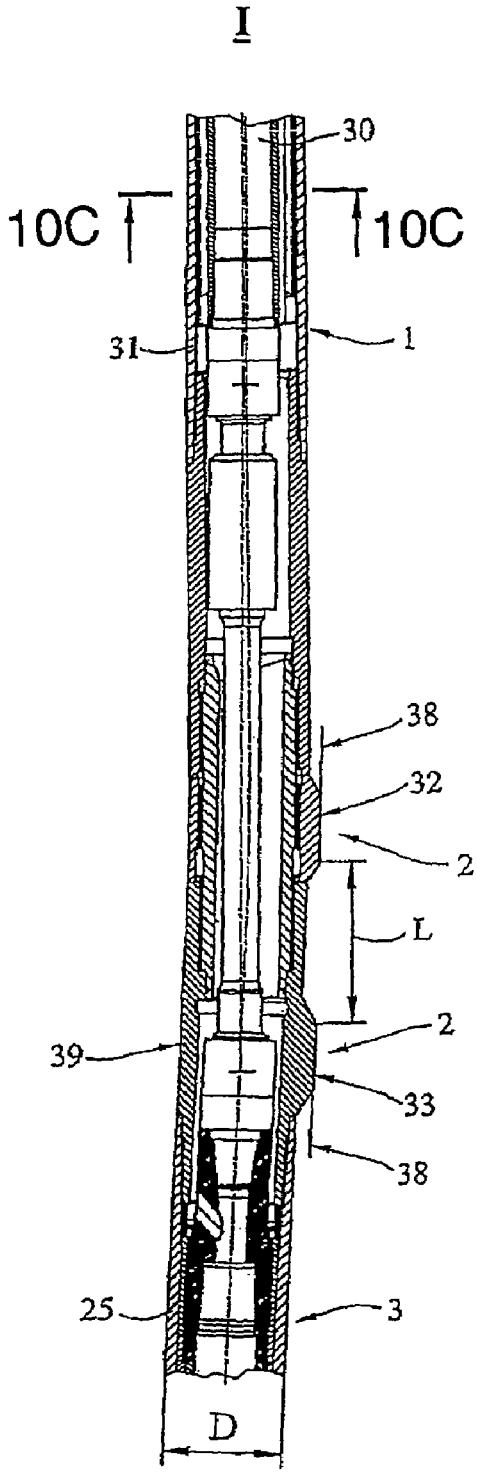
FIG. 2 shows the illustrated in FIG. 1 element I of the gerotor type motor output portion, which motor is connected to the spindle by the regulator of angle and reactive moment.

A gerotor type motor 1 having a regulator 2 of angle and reactive moment, a spindle 3 and a drilling bit 4 in a bent drilling string 5 is shown in FIGS. 1, 2.

The regulator 2 of angle and reactive moment of the gerotor type motor 1 consists of a central hollow element 6 (FIG. 3) and three hollow tubular elements 7, 8 and 9 connected to said central element 6, each one of said three elements having an inner through opening 10, 11, 12 respectively.

Figure 3:
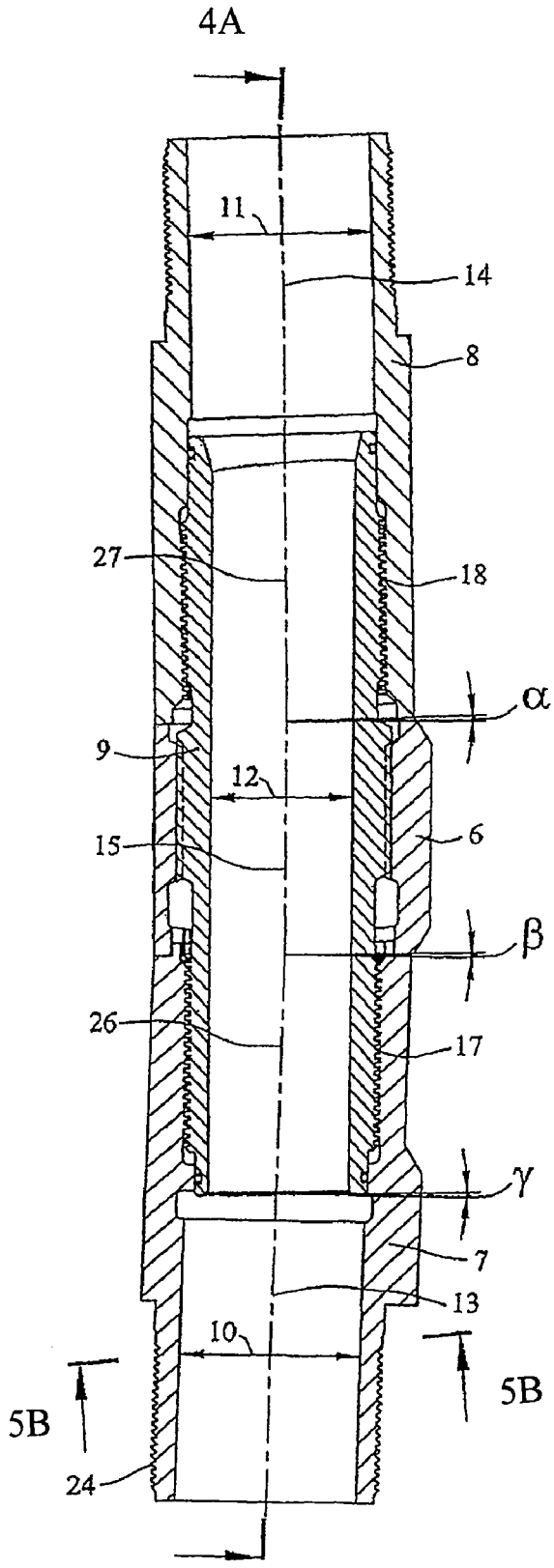
FIG. 3 shows the regulator of angle and reactive moment of the gerotor type motor in the drilling string bend plane.
Figure 4:
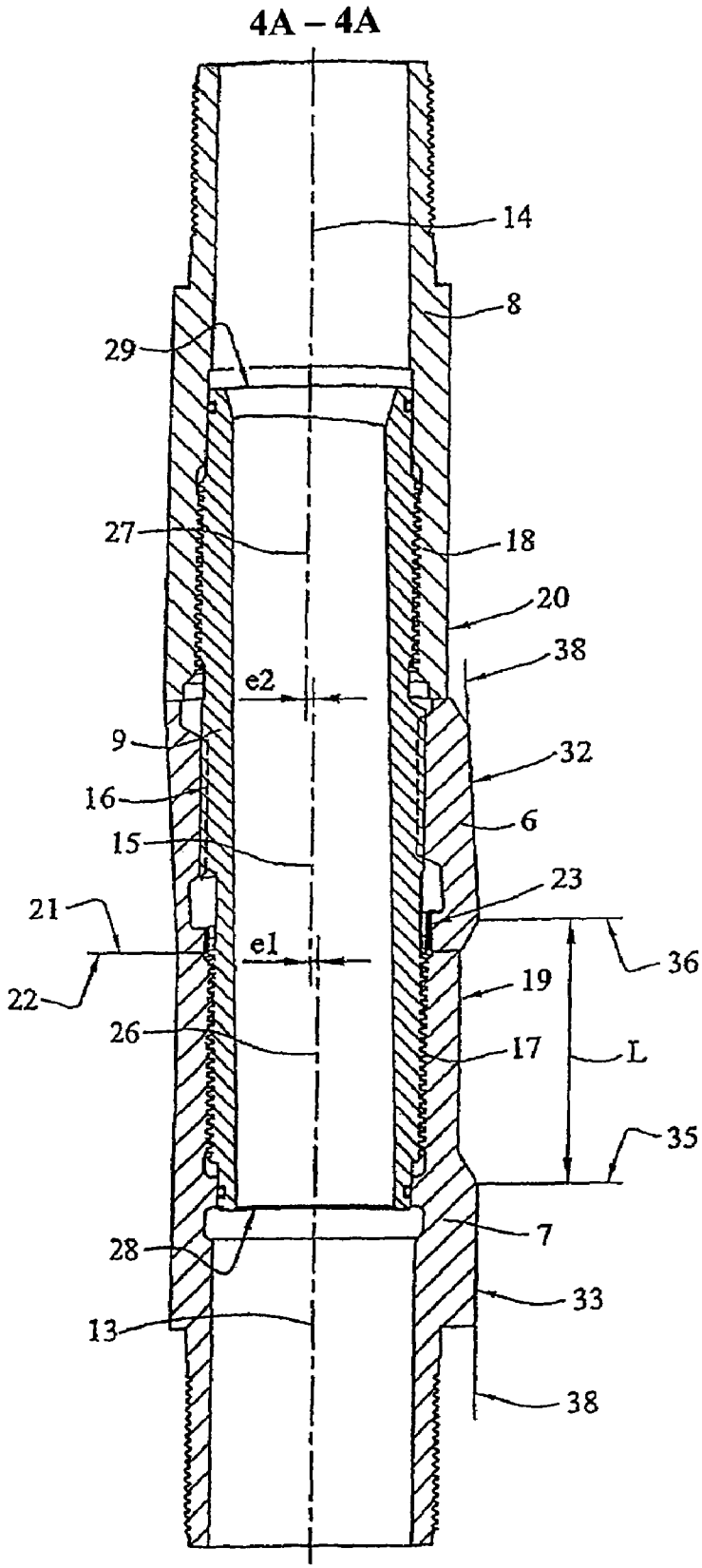
FIG. 4 shows cross-section along line 4A-4A of FIG. 3.

The first hollow tubular element 7 has an axis 13, the second tubular element 8 has an axis 14, and the inner hollow tubular element 9 is disposed in the centre between the first tubular element 7 and the second tubular element 8 and has an axis 15 (FIGS. 3, 4). The central hollow tubular element 6 is connected to the inner hollow tubular element 9 by splines 16 (FIGS. 4, 9).

The first hollow tubular element 7 and the second hollow tubular element 8 are connected to the inner hollow element 9 by threads 17, 18 on edges 19, 20 that face one another.

Figure 6:
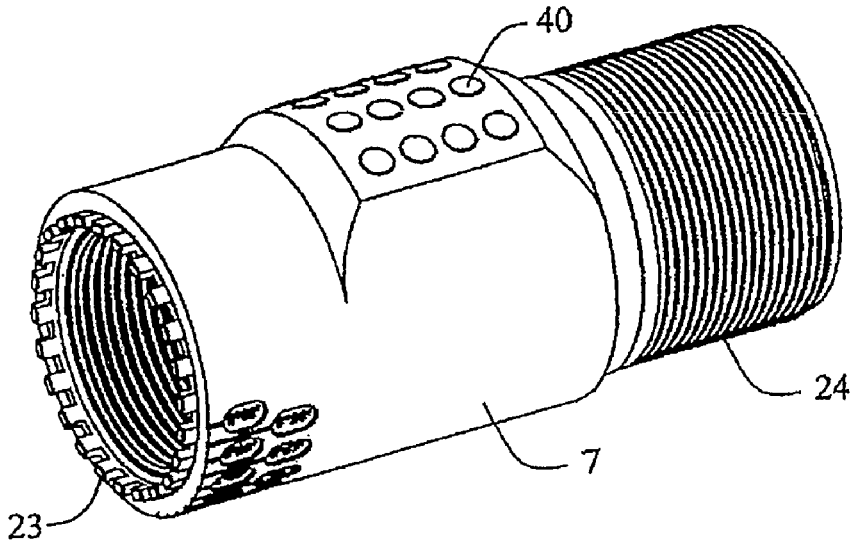
FIG. 6 shows a perspective view of the first hollow tubular element.
Figure 9:
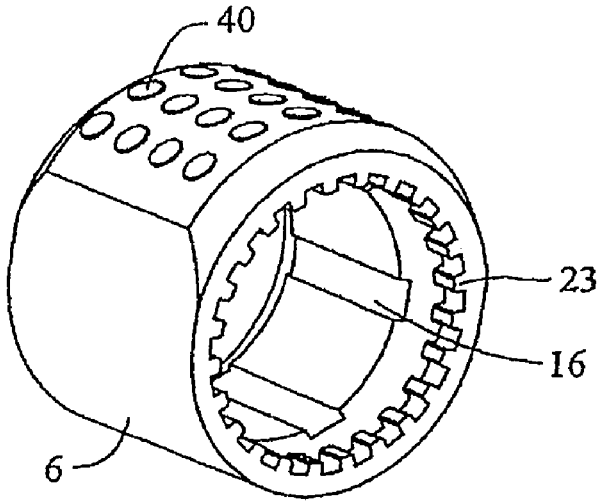
FIG. 9 shows a perspective view of the central hollow element.

An edge 21 of the first hollow tubular element 7 and an edge 22 of central hollow element 6 are provided with splines 23, using which splines a desired value of angle and reactive moment of the regulator are set (FIGS. 4, 6, 9).

The first hollow tubular element 7 is connected, by a thread 24, to the housing 25 of the spindle 3 of the gerotor type motor 1.

Axes 26 and 27 of threads 17 and 18 on edges 28, 29 of the inner hollow element 9 (FIG. 4) cross each other and the central axis 15 of the hollow element 9.

The longest distance between the axes 26 and 27 of the threads 17 and 18 is 2E, i.e. the double value of eccentricity E of a rotor 30 with respect to a stator 31 of the gerotor type motor 1 (FIG. 4, 10).

Figure 10:
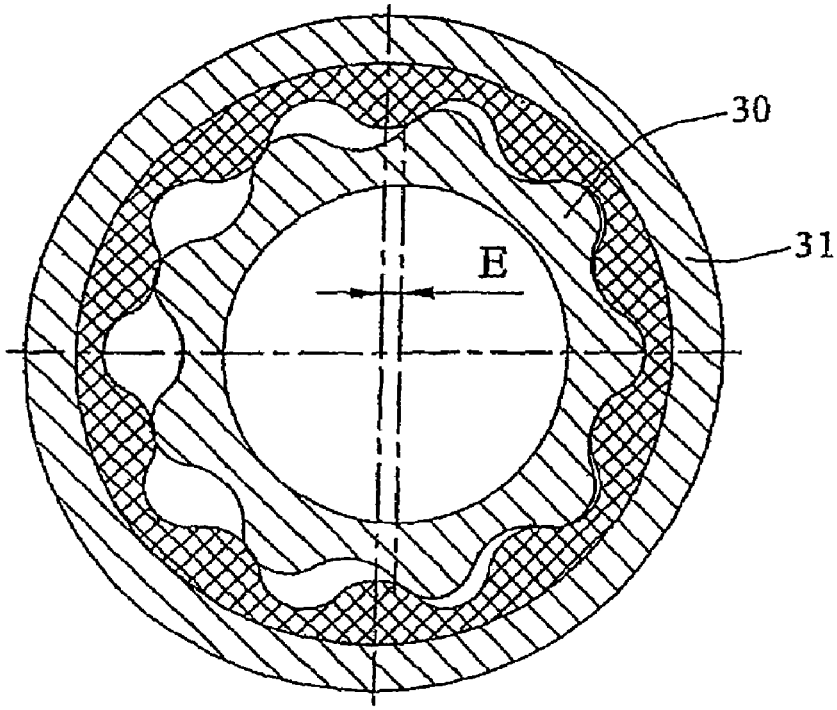
FIG. 10 shows cross-section along line 10C-10C of FIG. 2.

The longest distance between the central axis 15 of the inner hollow element 9 and the axes 26 and 27 of the threads 17 and 18 on its edges 28 and 29 is equal to eccentricity E of the rotor 30 with respect to the stator 31 of the gerotor type motor 1 (FIGS. 4, 10).

The axes 26, 27 on edges 28, 29 of the inner hollow element 9 exposed to the asymmetric load exerted by the gerotor type motor s reactive moment are disposed, respectively, at different distances e1 and e2 of its central axis 15 (FIG. 4).

Angle $\alpha$ is formed between the central axis 15 of the inner hollow element 9 and the axis 27 of the thread 18.

Angle $\beta$ is formed between the central axis 15 of the inner hollow element 9 and the axis 26 of the thread 17.

The first hollow tubular element 7 may have the bent axis 13 of its threaded portion 24 at angle $\gamma$ with respect to the central axis 15 of the inner hollow tubular element.

The central hollow element 6 and the first hollow tubular element 7, at the side of its connection to the spindle 3, are each provided with their own contact segmental section 32, 33 respectively, which constitute the pair of the contact segmental sections disposed at different sides with respect to meridian plane 34 of the spindle 3 in the drilling string bend plane, for example in the plane of FIG. 1. Proximate edges 35, 36 of the contact segmental sections 32, 33 are disposed at distance L along the central axis 15 of the first hollow tubular element 7, which distance has the following relationship with the outer diameter D of the spindle 3:

$$L \geqq D; \qquad \text{(FIG. 2, 4)}$$

Figure 5:
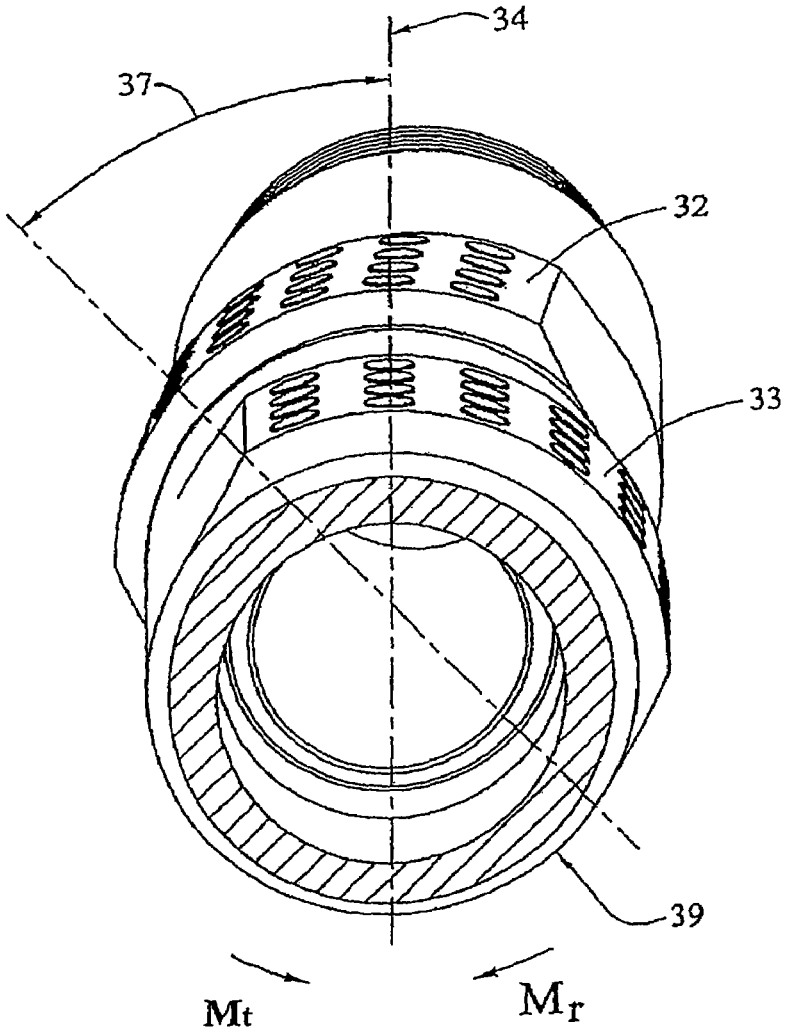
FIG. 5 shows cross-section along line 5B-5B of FIG. 3.

Angular deviation 37 of the contact segmental section 33 of the first hollow tubular element 7 (in cross-section) from the spindle meridian plane 34 in the bend plane of the drilling string 5 is provided in the opposite direction relative to the reactive moment $M_r$ imparted by the drilling bit 4 (FIG. 5).

Generatrices 38 of the contact segmental sections 32, 33 on the central hollow element 6 and on the first hollow tubular element 7 are disposed over the external surface 39 of the respective hollow element 6 or 7 (FIG. 2).

Figure 7:
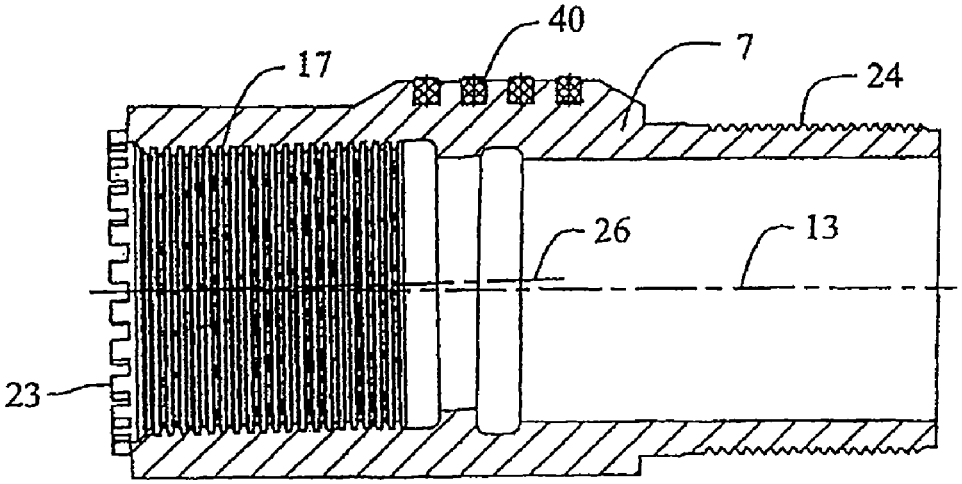
FIG. 7 shows the first hollow tubular element in the cross-section made along the axis of its threaded edge.
Figure 8:
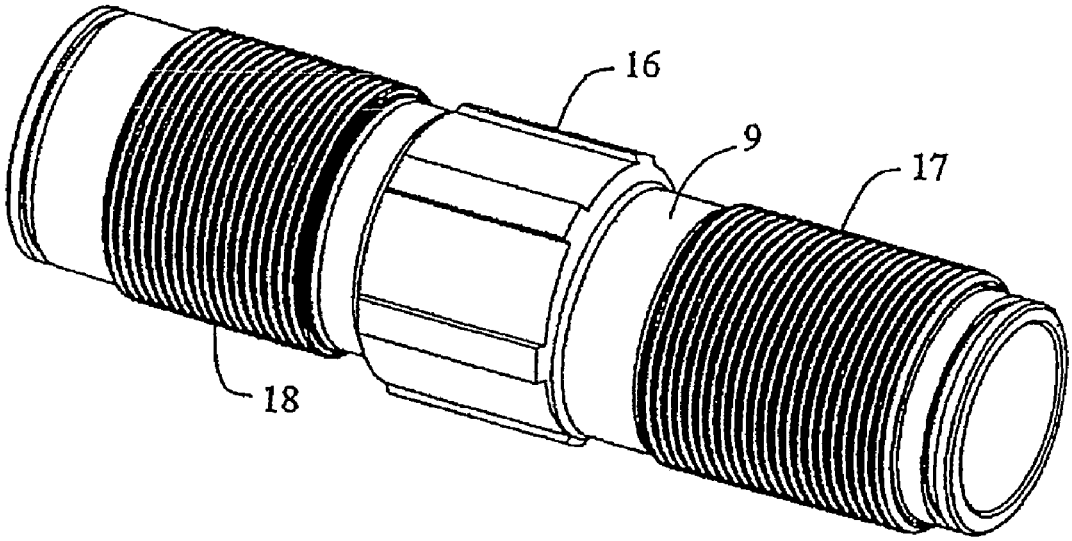
FIG. 8 shows a perspective view of the inner hollow tubular element.

The contact segmental sections 32, 33 comprise rows of teeth or pins 40 secured on their. walls; hardness of said teeth or pins being greater than that of said sections 32, 33 of the respective tubular element 6 or 7 (FIGS. 6, 7, 9).

The regulator of angle and reactive moment of the gerotor type motor having the spindle and the drilling bit in the bent drilling string operates as follows.

A pressurised flush fluid is delivered, through the drilling string 5, to helical cavities between the rotor 30 and the stator 31. The torque occurs on the rotor 30 and causes its orbital motion about stator 31, which motion—by means of cardan joints, drive shaft is converted into rotary motion of a rotor of the spindle 3 and the drilling bit 4.

In drilling the heterogeneous rocks, on the regulator 2 of angle and reactive moment and also on the spindle 3, the gerotor type motor 1 and the drilling bit 4 the reactive bending moment $M_r$ occurs due to the cutting forces applied on drilling bit 4. Said reactive moment $M_r$ is compensated owing to the presence of the inner hollow tubular element 9 having the axes 26 and 27 of the threads 17, 18 on its edges 28, 29, which axes cross over one another and the central axis 15 of said element.

Orbital motion of the rotor 30 within the stator 31 is directed oppositely to transmission of torque from the rotor 30 onto the spindle 3 and the drilling bit 4. A shift (in cross-section) of the axes 26 and 27 relative to the axis 15 is done against rotation of the drilling bit 4, as in this case any loss of direction, i.e. sign of stability of the bent string at the positive and negatives peaks of fluctuations of the axial load on drilling bit 4 is not observed.

Accuracy of the shift of the centre of rotation of the drilling bit 4 against rotation of the drilling bit, i.e. against its torque $M_t$, is further improved by provision of each of the central hollow element 6 and the first hollow tubular element 7, at the side where the element 7 connects to the spindle 3, with their own contact segmental sections 32, 33, respectively which constitute a pair of the contact segmental sections disposed at different sides with respect to the meridian plane 34 of the spindle 3 in the plane of bend of the drilling string 5, and along the central axis 15 of the first hollow tubular element 7 they are disposed at distance L between the proximate edges of contact segmental sections 32, 33, which distance has the following relationship with the spindle outer diameter D: $L \geqq D$, and also together they form angular deviation 37 of the contact segmental section 33 of the first hollow tubular element 7 from the spindle meridian plane 34 in the drilling string bend plane, which deviation is provided in the opposite direction relative to the reactive moment $M_r$ imparted by drilling bit 4.

This arrangement allows to optimize and to compensate the lateral force in the bent drilling string head, preventing a change in the inclination angle due to re-distribution of reactions of the lateral force acting on the drilling bit depending on the axial load, without loss of stability of a bent drilling string.

In practice, a vertical borehole is drilled to a predetermined depth. Then the drilling string is lifted, the inner hollow tubular elements 7 and/or 8 are partially unscrewed on the thread 17 and/or 18, afterwards central the hollow element 6 is slidingly moved along the splines 16.

As this occurs, the splines 23 of the first hollow tubular element 7 disengage from the central hollow element 6 to set a desired value of the angle and the reactive moment of gear-rotored motor 1.

The claimed design of the regulator improves stability of the gerotor type motor, regulator and spindle in the drilling string bend plane, increases the deviation angle and improves accuracy of penetration into an heterogeneity of a well bottom by the gerotor type motor having the spindle and the drilling bit in the bent drilling string by the use of compensation of the resultant radially-unbalanced force that is generated during rotation of the drilling bit in the borehole, and by holding the own contact segmental sections on the regulator, at different sides with respect to the drilling string bend plane, in contact with the borehole wall during drilling.

INDUSTRIAL APPLICABILITY

The invention can be suitably used in oil- and gas-producing industry for extraction of oil and gas from wells, and also in other industries where hydraulic motors are used.

The invention claimed is:

1. A regulator of angle and reactive moment of a gerotor type motor having a spindle and a drilling bit in a bent drilling string, comprising:

a central hollow element and three hollow mutually misaligned tubular elements connected to the central hollow element, each of which three tubular elements having an inner through opening;

an inner hollow tubular element being disposed in the centre between a first and a second hollow tubular elements;

the first and second hollow tubular elements being connected to the inner hollow tubular element by threads provided on their edges that face one another;

the first hollow tubular element being connected by a thread to the spindle;

the second hollow tubular element being connected by a thread to a motor housing;

the central hollow element being connected to the inner hollow tubular element by splines;

the inner hollow tubular element having threads on its edges, the threads having axes that cross one another and the central axis of the inner hollow tubular element;

a longest distance between the threads axes is the double value of a rotor eccentricity with respect to a gerotor type motor stator;

a longest distance between the central axis of the inner hollow tubular element and any of the threads axes being equal to the rotor eccentricity with respect to the gerotor type motor stator;

wherein the central hollow element and the first hollow tubular element, at the side where the first hollow tubular element is connected to the spindle, both are provided with their own contact segmental sections, the contact segmental sections constitute a pair of the contact segmental sections disposed at different sides with respect to a spindle meridian plane in a drilling string bend plane, wherein proximate edges of the contact segmental sections are disposed along the central axis of the first hollow tubular element at a distance L, which has the following relationship with spindle outer diameter $D:L \geqq D$, and an angular deviation of the first hollow tubular element's contact segmental section from the spindle meridian plane in the drilling string bend plane being provided in the opposite direction relative to the reactive moment imparted by the drilling bit.

2. The regulator of angle and reactive moment of a gerotor type motor according to claim 1, wherein generatrices of the contact segmental sections on the central hollow element and on the first hollow tubular element are disposed over external surfaces of the respective tubular elements, and each contact segmental section comprises rows of teeth or pins secured on the tubular element, wherein hardness of the teeth or pins is greater than that of the sections.

* * * * *